US006813468B2

(12) United States Patent
Takami et al.

(10) Patent No.: US 6,813,468 B2
(45) Date of Patent: Nov. 2, 2004

(54) IMAGE FORMING DEVICE WITH A CLEANING UNIT

(75) Inventors: Takeshi Takami, Nagoya (JP); Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/224,394

(22) Filed: Aug. 21, 2002

(65) Prior Publication Data

US 2003/0039495 A1 Feb. 27, 2003

(30) Foreign Application Priority Data

Aug. 23, 2001 (JP) ..... P2001-253404

(51) Int. Cl.[7] ..... G03G 21/00
(52) U.S. Cl. ..... 399/357; 399/123
(58) Field of Search ..... 399/357, 71, 123, 399/149, 34, 343, 353, 354, 98, 99, 100, 349; 15/1.51, 256.52; 430/125

(56) References Cited

U.S. PATENT DOCUMENTS 3,656,200 A * 4/1972 Riley, Jr. ..... 399/343
4,181,425 A * 1/1980 Higaya et al. ..... 399/357
5,530,537 A * 6/1996 Thayer ..... 399/357
6,415,119 B2 * 7/2002 Nishimura et al. ..... 399/98
2001/0031154 A1 * 10/2001 Sato et al. ..... 399/98

FOREIGN PATENT DOCUMENTS

| | | |
|---|---|---|
| JP | A 9-127844 | 5/1997 |
| JP | A 9-292809 | 11/1997 |
| JP | A 9-319278 | 12/1997 |
| JP | A 10-39705 | 2/1998 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

A cleaner includes a first roller and a second roller. The first roller is for removing foreign matter from a photosensitive body of an image forming device. The second roller is disposed in confrontation with the first roller. An electric field developed between the first roller and the second roller moves foreign matter having a predetermined charge polarity from the surface of the first roller to the surface of the second roller.

16 Claims, 4 Drawing Sheets

IMAGE FORMING DEVICE WITH A CLEANING UNIT

BACKGROUND OF THE INVENTION

1. Field of the Invention

The present invention relates to a corona charger used in an electrophotographic imaging device, such as a laser beam printer.

2. Description of the Related Art

A conventional image forming device, such as a laser beam printer, includes a photosensitive drum and a process unit. The process unit includes a charger, a scanner unit, a developing roller, and a transfer roller, which are disposed in the stated order around the periphery of the photosensitive drum in confronting relation with the peripheral surface of the photosensitive drum. As the photosensitive drum rotates, the drum is uniformly charged by the charger and then exposed to a laser beam emitted from the scanner unit. The laser beam, which is modulated in accordance with image data, scans the charged surface of the photosensitive drum at a high speed to form an electrostatic latent image on the photosensitive drum.

The process unit further includes a toner box holding toner. The toner contained in the toner box is supplied to the developing roller to form a thin film of toner on the surface of the developing roller. Rotation of the developing roller brings the toner into confrontation with the photosensitive drum. The toner is attracted to the static-electric latent image formed on the surface of the photosensitive drum, so that the static-electric latent image is developed into a visible toner image. When the visible toner image moves into confrontation with the transfer roller, the visible toner image is transferred onto a sheet that passes between the photosensitive drum and the transfer roller.

In a "cleanerless" image forming device, toner that remains on the photosensitive drum after transfer of toner onto the sheet is collected by the developing roller. Because the residual toner is collected in this manner, there is no need to provide a blade or other components for cleaning the photosensitive drum or a waste-toner box for holding the toner that was cleaned off from the photosensitive drum. As a result, "cleanerless" image forming devices have a simpler configuration, are more compact, and less expensive.

Sometimes a "cleanerless" image forming device cannot collect all of the residual toner using the developing roller when a great deal of toner remains on the photosensitive drum after visible image transfer. As a result, the residual toner can influence the next visible toner image formed on the photosensitive drum and appear as a ghost image. Therefore, "cleanerless" process units usually also include a cleaning roller in contact with the photosensitive drum at a position downstream with respect to the rotational direction of the photosensitive drum. The cleaning roller is made from a resilient and conductive material. During image forming processes, the cleaning roller is applied with a bias (negative bias) that is lower than the bias at the surface of the photosensitive drum when the visible toner image is transferred onto the sheet, so that the toner remaining on the photosensitive drum is temporarily collected onto the cleaning roller. At periods of non-image transfer, that is, in between successive sheets, the cleaning roller is applied with a bias (positive bias) that is higher than the bias at the surface of the photosensitive drum. Toner that was temporarily collected by the cleaning roller is returned back to the photosensitive drum and the returned toner is then collected by the developing roller.

Japanese Patent-Application Publication No. 9-127844 discloses a conductive brush member for removing paper dust that clings to the photosensitive drum during printing operations. The brush member is disposed in sliding contact with the surface of the cleaning roller and removes paper dust that is mixed in with toner that was temporarily collected by the cleaning roller. The brush member is applied with the same bias as the cleaning roller or applied with a voltage having the same polarity as the toner that was temporarily collected by the cleaning roller.

However, the brush member has a coarse fiber density so that tips of the brush fibers do not uniformly contact the entire outer peripheral surface of the rotating cleaning roller. Therefore, paper dust is not efficiently removed.

SUMMARY OF THE INVENTION

The present invention has been made to solve the aforementioned problems, and accordingly it is an object of the invention to provide an image forming device that can efficiently remove paper dust by abutting a secondary roller against the cleaning roller and maintain a high printing quality.

To achieve the above and other objects, there is provided a cleaner that includes a first roller and a second roller. The first roller is for removing foreign matter from a photosensitive body of an image forming device. The second roller is disposed in confrontation with the first roller. An electric field developed between the first roller and the second roller moves foreign matter having a predetermined charge polarity from the surface of the first roller to the surface of the second roller.

With this configuration, after foreign objects are completely removed from the photosensitive member by the first roller, the electric field operating between the first roller and the second roller selects only those foreign objects that have the predetermined charge polarity and moves them to the second roller. This ensures that only desired foreign objects of two types of different-polarity foreign objects are reliably removed.

It is desirable to further provide a slide-contact member that contacts the surface of the second roller and scrapes foreign matter from the surface of the second roller. With this configuration, the foreign objects moved to the second roller can be mechanically removed by the slide-contact member. Therefore, foreign objects will not accumulate on the second roller. A clean surface of the second roller, free of foreign objects, will always confront the first roller so that foreign objects will not be returned back to the first roller. Object removal can be more efficiently performed. It is desirable that the slide-contact member includes a porous material made from at least one of sponge and unwoven fabric. With this configuration, the porous portion of the slide-contact member can mechanically trap and hold foreign objects. The foreign objects can be reliably prevented from returning back to the second roller. Moreover, slide-contact member has a large capacity for holding foreign objects, and so can be used for a long time, which proves to be economical.

It is desirable to further comprising a first voltage application unit for applying voltage to the first roller, a second voltage application unit for applying voltage to the second roller, and a control unit. The control unit controls the first voltage application unit to change polarity of voltage applied to the first roller to one polarity when toner is to be drawn from the photosensitive body and to the opposite polarity when toner is to released onto the photosensitive body. The control unit further controls the second voltage application unit to apply voltage to the second roller that does not change the direction of the electric field between the first roller and the second roller, even if the second voltage application unit changes voltage applied to the first roller.

With this configuration, toner that remained in image regions of the photosensitive member after image transfer is once collected on the first roller and then returned back to the non-image regions for the photosensitive member. As a result, toner is not wasted. Moreover, because the voltage applied to the second roller is controlled so as to not change the electric field between the first roller and the second roller, even if the voltage applied to the second roller is switched. Therefore, when the foreign objects have a different polarity than the toner, the foreign objects that are collected on the first roller with the toner can be selectively removed by the electric field to the second roller. Therefore, the configuration for removing foreign objects is a simple configuration that adds only the second roller to the first roller. Production cost can be reduced.

In this case, it is desirable that the first roller has a higher peripheral speed than the photosensitive body. The first roller and the second roller contact each other at their outer peripheral surfaces at a contact portion and move in the same direction at the contact portion. With this configuration, even if the toner and foreign objects are mixed on the first roller, the electric field can selectively remove only foreign objects without having to mechanically scrape toner off the second roller using a difference in peripheral speed between the first and second rollers. Toner will not be wasted.

When the outer surface of the first roller is a resilient and porous member, then the first roller will have a large surface area that enhances the capacity to remove foreign objects and toner using the electric field. Further, the first roller contacts the photosensitive member with a larger surface area so that the effects of mechanical removal of toner and foreign objects is enhanced.

When the second roller is conductive and has a smooth surface, there is no need to mechanically scrape toner and foreign objects, which have different polarities, from the first roller using the second roller. The foreign objects cling to the second roller by the electric field and the mechanical removal of foreign objects by the slide-contact member can be enhanced.

It is desirable that the first roller removes foreign objects from the photosensitive member using a combination of mechanical scraping-off force and electrostatic drawing force. The second roller selectively draws only paper dust from the first roller using mainly electrostatic drawing force. With this configuration, toner that was collected on the first roller can be returned to the photosensitive member without moving to the second roller and foreign objects that cling to the first roller can be moved to the second roller.

An image forming device that includes a photosensitive body and the inventive cleaner has a more compact size and simpler configuration. Also production costs are reduced.

It is desirable that the image forming device further include a charge unit that develops a uniform charge on the photosensitive member, a developing unit that develops images on the photosensitive member using toner into visible images, and a transfer member that transfers the visible images from the photosensitive member onto sheets. The charge unit, the developing unit, the transfer member, and the first roller of the cleaner device are disposed around the photosensitive drum in this order starting from an upstream side with respect to rotational direction of the photosensitive body. When the image forming device has this configuration, a cleanerless type process unit can be configured. Toner will not be wastefully used. Also, the image forming device is more compact and reasonably priced.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
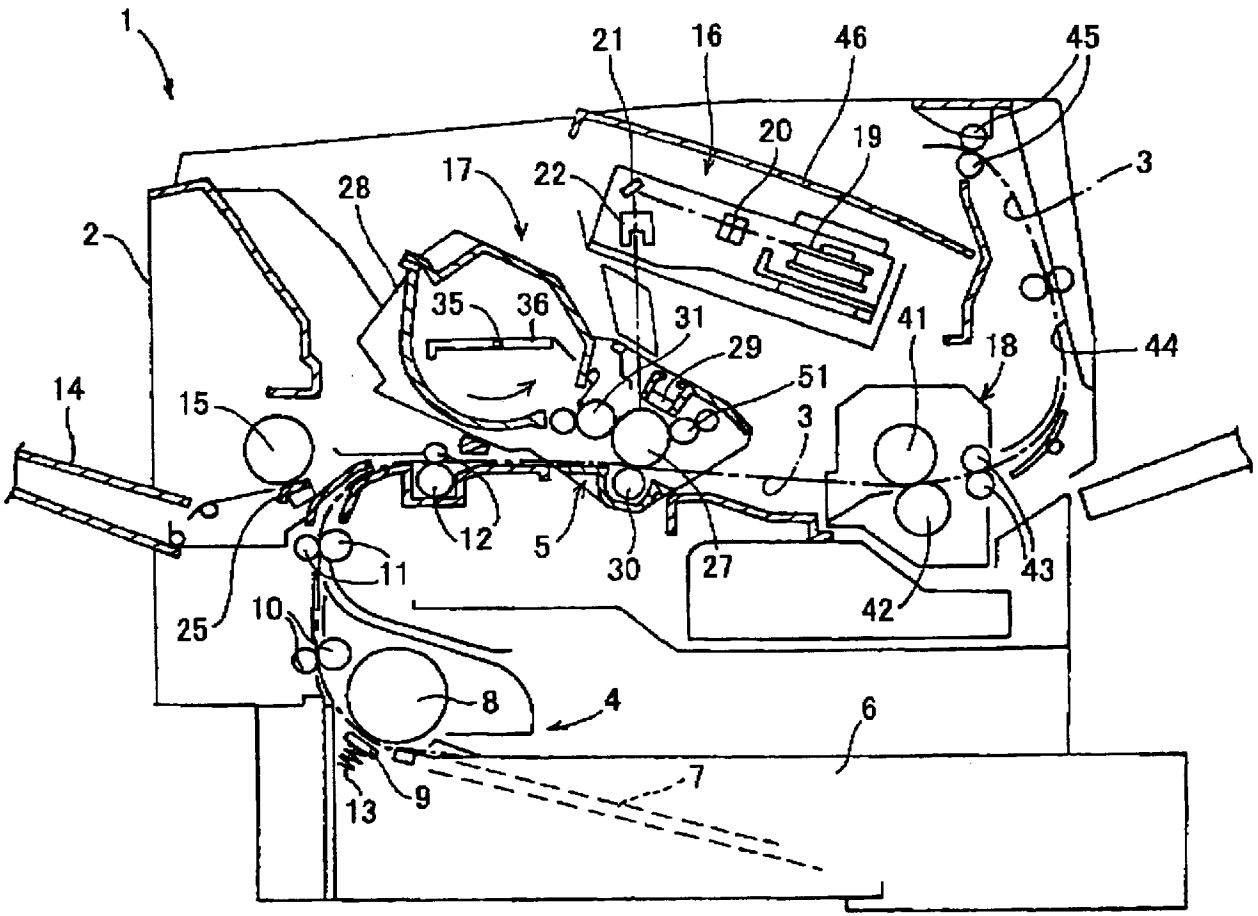
FIG. 1 is a cross-sectional view showing a laser beam printer according to an embodiment of the present invention.
Figure 2:
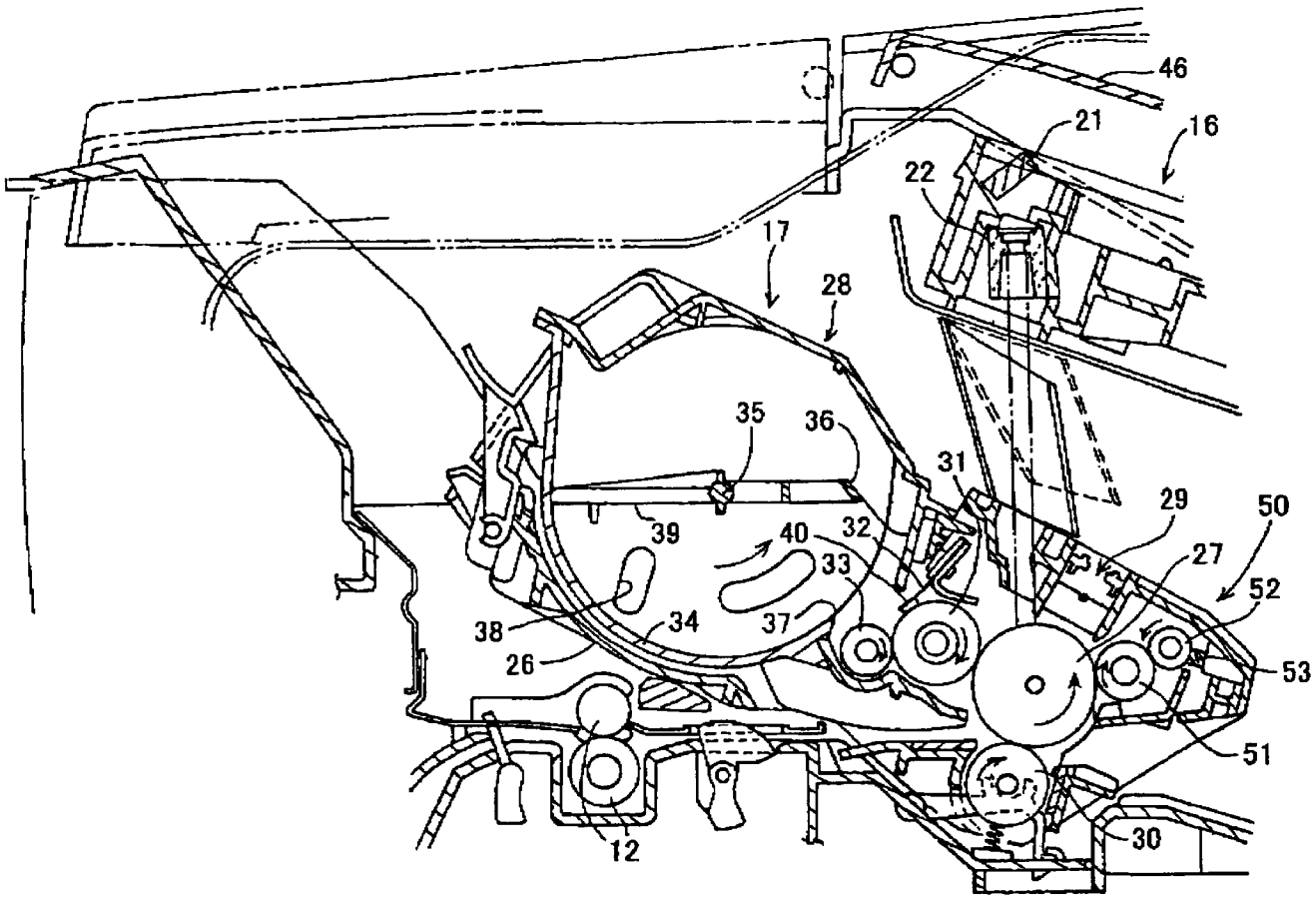
FIG. 2 is an enlarged cross-sectional view showing essential portions of a process unit of the printer.
Figure 3:
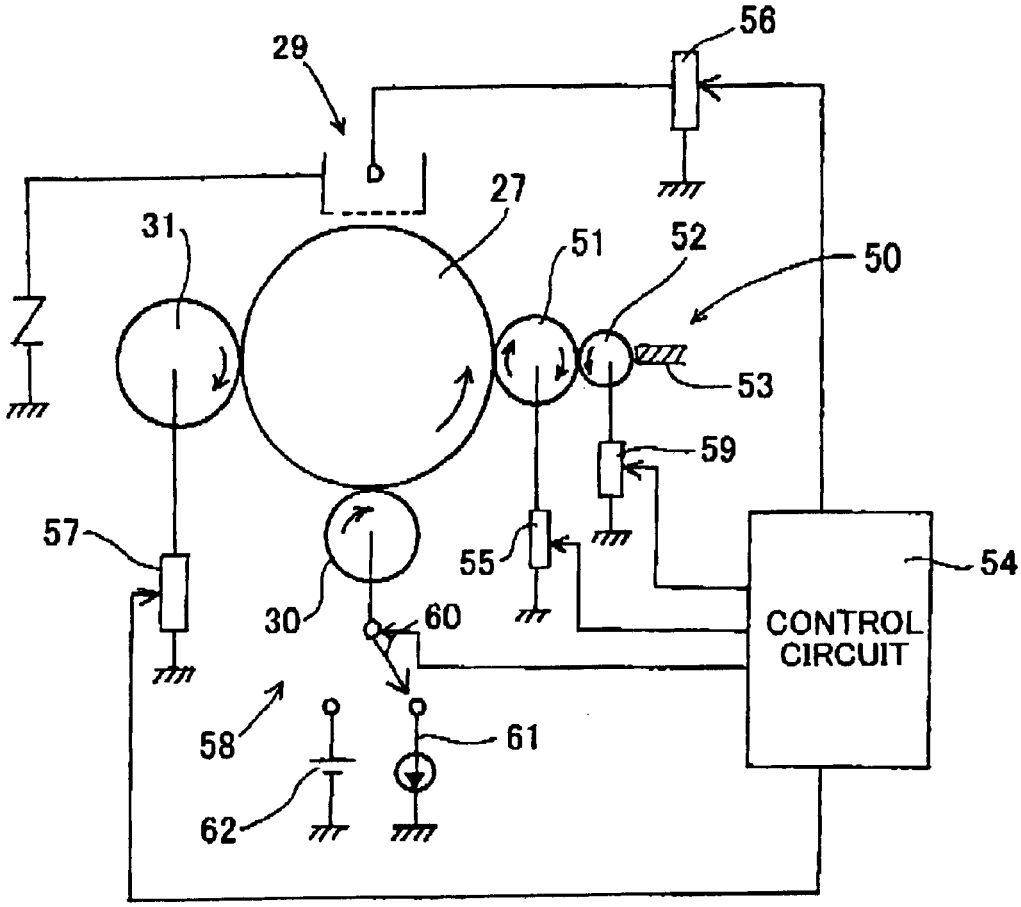
FIG. 3 is a block diagram showing a power source arrangement of the process unit.
Figure 4:
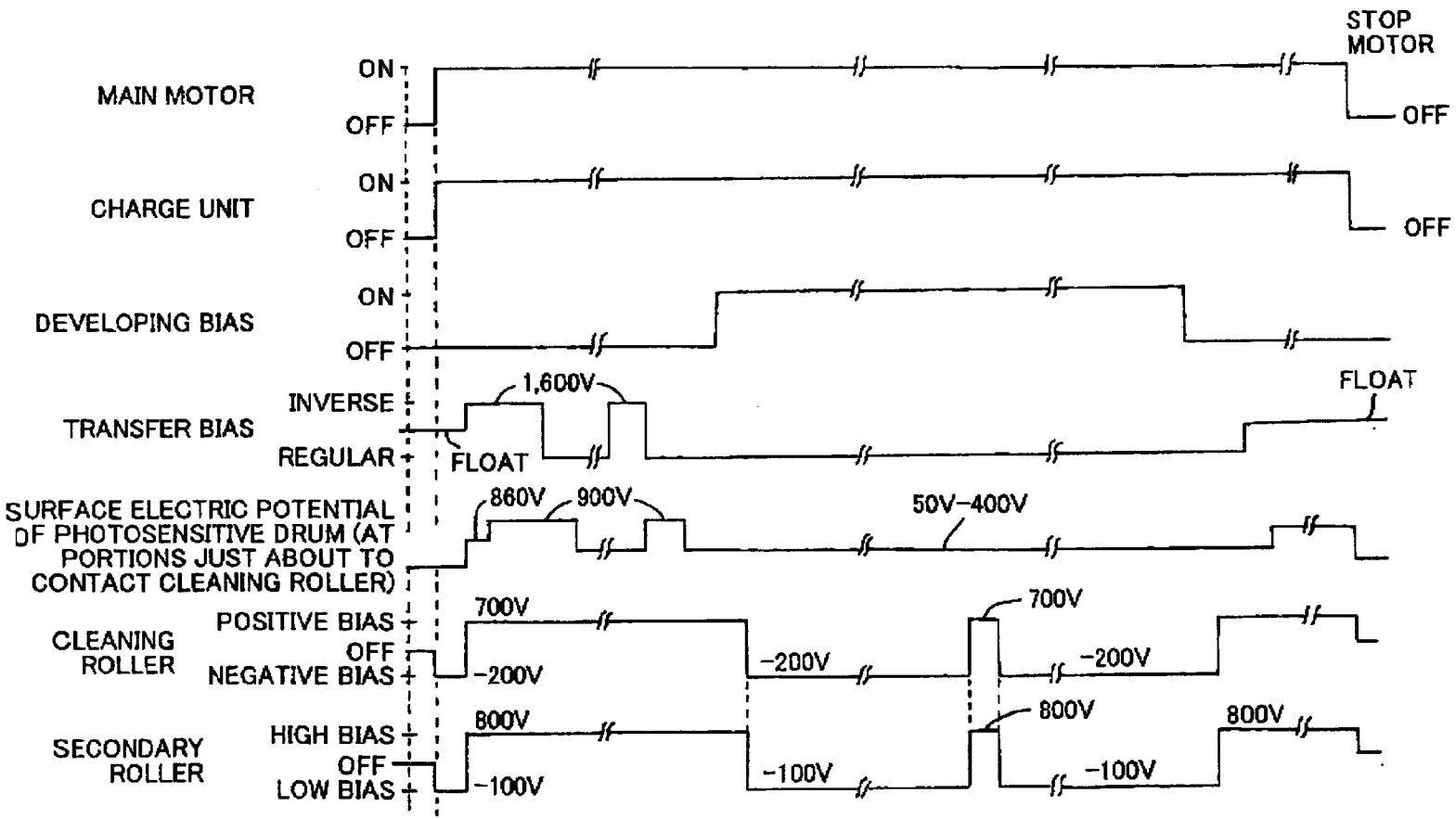
FIG. 4 is a timing chart for describing the operation of the power source arrangement.

A laser beam printer according to a preferred embodiment of the invention will be described with reference to the accompanying drawings. FIG. 1 is a cross-sectional view showing the laser beam printer. FIG. 2 is an enlarged cross-sectional view showing essential portions of a process unit. FIG. 3 is a block diagram showing a power source arrangement of the process unit. FIG. 4 is a timing chart for describing the operation of the power source arrangement.

The terms "upward", "downward", "upper", "lower", "above", "below", "beneath" and the like will be used throughout the description assuming that the laser beam printer is disposed in an orientation in which it is intended to be used.

Referring first to FIG. 1, the laser beam printer 1 has a housing 2 in which a sheet feed section 4 and an image forming section 5 are disposed. The image forming section 5 forms images on paper sheets supplied by the sheet feed section 4.

The sheet feed section 4 includes a sheet feed tray 6, a sheet urging plate 7, a sheet feed roller 8, a sheet feed pad 9, a pair of paper dust removing rollers 10, a pair of sheet feed rollers 11, and a pair of registration rollers 12. The sheet feed tray 6 is detachably provided on the bottom portion of the housing 2. The sheet urging plate 7 is disposed in the sheet feed tray 6. The sheet feed roller 8 is rotatably disposed above one end of the sheet feed tray 6. The paper dust removing rollers 10 are disposed downstream from the sheet feed roller 8 with respect to a sheet transport direction in which the sheets of paper are transported. The registration rollers 12 are disposed downstream from the sheet feed rollers 11 with respect to the sheet transport direction.

The sheet urging plate 7 is pivotally movably supported about its end portion remote from the sheet feed roller 8 and is upwardly biased by springs (not shown) provided on the lower side of the urging plate 7. A stack of sheets 3 is adapted to be placed on the urging plate 7. The free end portion of the urging plate 7 moves downward against the biasing force of the springs to an extent that depends upon how many sheets of paper are stacked in the sheet feed tray 6.

The sheet feed roller 8 and the sheet feed pad 9 are disposed in confronting relation with each other. The sheet feed pad 9 is pressed against the sheet feed roller 8 by a spring 13 disposed in the rear surface of the sheet feed pad 9. The tip end of the uppermost sheet 3 stacked in the sheet feed tray 6 is pressed against the sheet feed roller 8 by the spring biasing the sheet urging plate 7 upward, is gripped by the sheet feed roller 8 and the sheet feed pad 9, and then is transported by rotation of the sheet feed roller 8. The sheet of paper fed by the sheet feed roller 8 passes through the nip between the paper dust removing rollers 10. At this time, the paper dust removing rollers 10 remove paper dust from the sheet to a certain extent. Then, the sheet of paper is further transported by the sheet feed rollers 11 to the registration rollers 12, where the sheet of paper is subjected to registration, and then fed to the image forming section 5.

The sheet feed section 4 further includes a multi-purpose tray 14, a multi-purpose sheet feed roller 15, and a multi-purpose sheet teed pad 25. The multi-purpose sheet feed roller 15 and the multi-purpose sheet feed pad 25 supply sheets 3 that are stacked on the multi-purpose tray 14. The multi-purpose sheet feed roller 15 and the multi-purpose sheet feed pad 25 are disposed in mutual confrontation with each other. A spring disposed to the undersurface of the multi-purpose sheet feed pad 25 presses the multi-purpose sheet teed pad 25 toward the multi-purpose sheet feed roller 15. Rotation of the multi-purpose sheet feed roller 15 sandwiches sheets 3 that are stacked on the multi-purpose tray 14 between the multi-purpose sheet feed roller 15 and the multi-purpose sheet feed pad 25 and then feeds the sheets 3 one at a time to the registration rollers 12.

The image forming section 5 includes a scanner unit 16, a process unit 17, and a fixing unit 18.

The scanner unit 16 is provided in the upper section of the casing 2 and includes a rotating driven polygon mirror 19, lenses 20 and 22, and a reflection mirror 21. A laser emitting portion emits a laser beam modulated based on image data. As indicated by single-dot chain line in FIG. 1, the laser beam is reflected by the polygon mirror 19, passes through the lens 20, is reflected by the reflection mirror 21, and passes through the lens 22 to scan across the surface of a photosensitive drum 27 in the process unit 17 at a high speed.

The process unit 17 is disposed below the scanner unit 16. As shown in FIG. 2, the process unit 17 includes the photosensitive drum 27, a developing cartridge 28, a scorotron charge unit 29, a transfer roller 30, and a cleaning unit 50. These components of the process unit 17 are housed in a drum case 26, which is freely detachably mounted on the casing 2.

The developing cartridge 28 is detachably mounted with respect to the drum case 26. The developing cartridge 28 includes a developing roller 31, a layer-thickness regulating blade 32, a supply roller 33, and a toner box 34.

The toner box 34 is filled with non-magnetic single-component toner having a positively charging nature. In the present example, the toner filling the toner box 34 is a polymer toner obtained by co polymerization of a monomer with a polymerizing nature. The co polymerization can be performed by a well-known polymerization method such as suspension polymerization. Examples of monomers that can be used include a styrene monomer, such as styrene, or an acrylic monomer, such as acrylic acid, alkyl (C1–C4) acrylate, and alkyl (C1–C4) meta acrylate. The polymer toner particles are spherical so that the toner has extremely high fluidity. Also, coloring agents, such as carbon black, and wax are dispersed in the toner. Also, an external additive such as silica is added to increase fluidity of the polymer toner. The toner particles have a particle size of between about 6 to 10 micrometers.

A rotation shaft 35 is provided in the center of the toner box 34. An agitator 36 is supported on the rotation shaft 35. The agitator 36 rotates in the counterclockwise direction as indicated by an arrow in FIG. 2. This stirs up the toner in the toner box 34 and also pushes the toner out through a toner supply opening 37 that is opened in the side of the toner box 34. A window 38 is formed in the side wall of the toner box 34. The window 38 is for detecting how much toner remains in the toner box 34. Also, a cleaner 39 is supported on the rotation shaft 35 for cleaning the window 38.

The supply roller 33 is disposed at the side of the toner supply opening 37. The supply roller 33 is rotatable in the clockwise direction as indicated by an arrow in FIG. 2. The developing roller 31 is disposed in confrontation with the supply roller 33 and is rotatable in the clockwise direction as indicated by an arrow in FIG. 2. The supply roller 33 and the developing roller 31 abut against each other so that each is compressed by a certain extent.

The supply roller 33 is a conductive foam roller that covers a metal roller shaft. The developing roller 31 is a conductive rubber roller that covers a metal roller shaft. In more concrete terms, the foam roller portion of the developing roller 31 includes a roller body with a coat layer covering its surface. The roller body is made from conductive silicone rubber or urethane rubber including carbon particles. The coat layer is silicon rubber or urethane rubber including fluoride. The developing roller 31 is applied with a developing bias by a developing bias application power source (not shown).

The layer-thickness regulating blade 32 is disposed next to the developing roller 31. The layer-thickness regulating blade 32 includes a blade body and a pressing portion 40. The blade body is made from a metal plate spring member. The pressing portion 40 is provided on the free tip of the blade body. The pressing portion 40 has a half circle shape in cross section and is made from silicone rubber with electrically insulating properties. The layer-thickness regulating blade 32 is supported on the developing cartridge 28 at a position near the developing roller 31. The resilient force of the blade body presses the pressing portion 40 against the surface of the developing roller 31.

The toner pushed out from the toner supply opening 37 is supplied to the developing roller 31 by rotation of the supply roller 33. The toner is charged to a positive charge by friction between the supply roller 33 and the developing roller 31. As the developing roller 31 rotates, the toner on the developing roller 31 enters between the developing roller 31 and the pressing portion of the layer-thickness regulating blade 32. The toner is further charged by friction between the developing roller 31 and the layer-thickness regulating blade 32 and regulated into a thin layer of uniform thickness on the developing roller 31.

The photosensitive drum 27 serves as an example of a photosensitive body and is disposed to the side and in confrontation with the developing roller 31. The photosensitive drum 27 is rotatable in the counterclockwise direction as indicated by an arrow in FIG. 2. The photosensitive drum 27 includes a drum body and a photosensitive layer with a positively charging nature. The drum body is connected to ground. The photosensitive layer covers the outer surface of the drum body and includes polycarbonate. The photosensitive drum 27 is driven to rotate by drive force from a main motor (not shown).

The scorotron charge unit 29 is disposed above the photosensitive drum 27 and separated from the photosensitive drum 27 by a predetermined distance so as not to contact the photosensitive drum 27. The scorotron charge unit 29 is a positively-charging scorotron type charge unit that generates a corona discharge from a charge wire made from tungsten, for example. The scorotron charge unit 29 uniformly charges the surface of the photosensitive drum 27 to a uniform positive polarity. The scorotron charge unit 29 is turned ON and OFF by a charge power source (not shown).

In association with rotation of the photosensitive drum 27, first the scorotron charge unit 29 charges the surface of the photosensitive drum 27 to a uniform positive charge. Then, the laser beam emitted from the scanner unit 16 scans across the photosensitive drum 27 at a high speed. The bias at the surface of the photosensitive drum 27 drops at portions of the uniformly charged surface that are exposed by the laser beam based on image data. The portions with bias lowered in this way form a static-electric latent image on the surface of the photosensitive drum 27 based on the image data.

When rotation of the developing roller 31 brings the positively charged toner borne on the developing roller 31 into confrontation with and contact with the photosensitive drum 27, the toner selectively clings to the static-electric latent image on the surface of the photosensitive drum 27, thereby developing the static-electric latent image into a visible toner image. As a result, inverse development is achieved.

The transfer roller 30 is disposed below the photosensitive drum 27 at a position in confrontation with the photosensitive drum 27. The transfer roller 30 is supported on the drum case 26 so as to be rotatable in the clockwise direction as indicated by an arrow in FIG. 2. The transfer roller 30 is a roller made from an ion conducting rubber material covering a metal roller shaft. As will be described later, a transfer bias application power source 54 applies a transfer bias (a regular transfer bias) to the transfer roller 30 when toner is to be transferred from the photosensitive drum 27. As a result, the visible toner image borne on the upper surface of the photosensitive drum 27 is transferred onto a sheet 3 that passes between the toner supply opening 37 and the transfer roller 30.

As shown in FIG. 1, the fixing unit 18 is disposed at the downstream of the process unit 17. The fixing unit 18 includes a thermal roller 41, a pressing roller 42, and a pair of transport rollers 43. The pressing roller 42 presses against the thermal roller 41. The transport rollers 43 are disposed at the downstream side of the thermal roller 41 and the pressing roller 42. The thermal roller 41 is made from metal and includes a halogen lamp for heating up. After toner is transferred onto a sheet 3 in the process unit 17, the sheet 3 passes between the thermal roller 41 and the pressing roller 42. Heat from the thermal roller 41 melts and fixes the toner onto the sheet 3. Afterward, the transport rollers 43 transport the sheet 3 to a discharge path 44. The sheet 3 transported to the discharge path 44 is transported to sheet-discharge rollers 45 and discharged onto a sheet-discharge tray 46.

The laser printer 1 uses the "cleanerless" method to collect residual toner from the surface of the photosensitive drum 27. That is, the developing roller 31 collects the toner that remains on the photosensitive drum 27 after toner is transferred onto the sheet 3. Because the cleaning unit 50 uses the "cleanerless" method to collect toner, there is no need to provide a means for holding waste toner. Therefore, the printer can be made with a simpler configuration, more compact, and less expensive.

The cleaning unit 50 enhances the effects of the "cleanerless" method. Next, the configuration of the cleaning unit 50 will be described in detail. As shown in FIGS. 2 and 3, the cleaning unit 50 includes a cleaning roller 51, a secondary roller 52, and a sliding contact member 53 provided in the drum case 26 of the process unit 17.

The cleaning roller 51 is supported in the drum case 26 and located at the side of the photosensitive drum 27 at a position downstream from the transfer roller 30, and upstream from the scorotron charge unit 29, with respect to rotational direction of the photosensitive drum 27. The cleaning roller 51 is supported in contact with the photosensitive drum 27 and is rotatable in the clockwise direction as indicated by an arrow in FIG. 2. As can be seen in FIG. 2, contacting surfaces of the cleaning roller 51 and the photosensitive drum 27 move in the same direction where they are in sliding contact with each other. The cleaning roller 51 is rotated so as to have a faster peripheral speed than the peripheral speed of the photosensitive drum 27, that is, 1.5 times that of the photosensitive drum 27 in the present embodiment. As a result, the cleaning roller 51 slidingly contacts the surface of the photosensitive drum 27 at a high speed so as to mechanically scrape foreign objects, such as paper dust and other objects other than toner, off the photosensitive drum 27. It should be noted that bias is selectively applied to cleaning roller 51 during image forming operations to enhance mechanical cleaning operation (of toner and paper dust) performed by the cleaner roller, and to selectively electrically draw toner to and from the cleaner roller 51.

The cleaning roller 51 is a roller covering a metal roller shaft. The roller portion is made from conductive rubber or other soft and porous material. For example, the roller portion can be made from a sponge rubber material such as conductive silicone rubber, urethane rubber, or Ethylene Propylene Diene Monomer (EPDM). The hardness of the sponge rubber material is about Asker C 35. By using such a sponge rubber, the surface area of the cleaning roller 51 increases, thereby enhancing the effects of removing foreign objects, such as paper dust, both mechanically and by difference in bias.

As shown in FIG. 3, a cleaning bias application power source 55 is provided for selectively applying the cleaning roller 51 with a positive bias, which serves as a reference bias, and a negative bias. The negative bias is applied during transfer periods, that is, while toner is being transferred from the photosensitive drum 27 to the sheet 3 during image forming operations. Therefore, during transfer periods, residual toner is continuously electrically drawn to the cleaning roller 51. On the other hand, the positive bias is applied during non-transfer periods, that is, periods in between sheets to be formed with toner images one after the other. When the positive bias is applied, toner that was electrically drawn to the cleaning roller 51 is electrically returned to the photosensitive drum 27. In this way, residual toner generated during image forming operations can be temporarily collected electrically. The residual toner electrically returned to the photosensitive drum 27 during non-transfer periods is charged to a positive polarity by the scorotron charge unit 29 when rotation of the photosensitive drum 27 moves the residual toner into confrontation with the scorotron charge unit 29 and then collected by the developing roller 31 when brought into confrontation with the developing roller 31.

Changes in transfer conditions, such as environmental and durability changes, can result in large amounts of toner remaining on the photosensitive drum 27 after transfer. The developing roller 31 will be unable to collect all of the residual toner by itself. By providing the cleaning roller 51, the residual toner can be temporarily recovered by the cleaning roller 51. The influence of the residual toner on the next visible toner image formed on the photosensitive drum 27 can be reduced so that ghosts and the like are not generated in the image.

The secondary roller 52 is aligned in parallel with the cleaning roller 51. The cleaning roller 51 and the secondary roller 52 are driven to rotate so that the outer peripheral surfaces of the cleaning roller 51 and the secondary roller 52 move in the same direction where the cleaning roller 51 and the secondary roller 52 contact each other. The secondary roller 52 removes and collects foreign objects such as paper dust that are mixed in with the toner that was moved from the photosensitive drum 27 to the cleaning roller 51, and also prevents the paper dust from being returned to the photosensitive drum 27 with toner that is returned from the cleaning roller 51 to the photosensitive drum 27.

The secondary roller 52 is made from a metal rotation shaft mounted with a material having conductive properties such as a metal roller portion plated with nickel on its surface. The cleaning roller 51 and the secondary roller 52 are rotated so as to rotate together in the same direction at their mutual contact surface. In this example, the cleaning roller 51 rotates in the clockwise direction of FIG. 2, so the secondary roller 52 is rotated in the counterclockwise direction, and also at the same peripheral speed. If the cleaning roller 51 and the secondary roller 52 were driven to rotate with a different peripheral speed where they contact, the secondary roller 52 would scrape off both paper dust and toner from the cleaning roller 51 so that the toner could not be returned from the cleaning roller 51 to the photosensitive drum 27. However, because the cleaning roller 51 and the secondary roller 52 have the same peripheral speed in the present embodiment, no scraping occurs between the cleaning roller 51 and the secondary roller 52. As will be described later, the biases applied to the cleaning roller 51 and the secondary roller 52 constantly result in the secondary roller 52 having a higher bias than the cleaning roller 51. As a result, negatively-charged paper dust can be easily and constantly moved from the cleaning roller 51 to the secondary roller 52.

The sliding contact member 53 is for removing paper dust that clings to the outer peripheral surface of the secondary roller 52. The sliding contact member 53 is disposed in sliding contact with the outer peripheral surface of the secondary roller 52 at one side of the secondary roller 52 and substantially parallel with the axial line of the secondary roller 52. The sliding contact member 53 is made from a soft material with a large surface area in a porous condition such as sponge or unwoven fabric. The sliding contact member 53 scrapes off paper dust that clings only by static electricity to the hard and smooth surface of the secondary roller 52. After the paper dust is caught up in the sliding contact member 53, it is returned from the sliding contact member 53 to the secondary roller 52.

FIG. 3 shows power source configuration for the process unit 17 of the laser printer 1. As shown in FIGS. 2 and 3, the process unit 17 includes the scorotron charge unit 29, the developing roller 31, the transfer roller 30 and the cleaning roller 51 disposed around the photosensitive drum 27 in this order following the rotational direction of the photosensitive drum 27.

The power source configuration of the laser printer 1 includes a charge power source 56, a development bias application power source 57, a transfer bias application power source 58, the cleaning bias application power source 55, a secondary roller bias application power source 59, and a control circuit 54. The control circuit 54 is connected to and controls the charge power source 56, the development bias application power source 57, the transfer bias application power source 58, the cleaning bias application power source 55, and the secondary roller bias application power source 59. FIG. 4 is a timing charge showing timing at which the various power sources are controlled.

The charge power source 56 is connected to the scorotron charge unit 29. The control circuit 54 controls the charge power source 56 to turn the scorotron charge unit 29 ON and OFF. When the charge power source 56 is turned ON, the scorotron charge unit 29 is turned ON and charges the surface of the photosensitive drum 27 to a bias of about 900 volts.

The development bias application power source 57 is connected to the roller shaft of the developing roller 31. The control circuit 54 controls the development bias application power source 57 to turn ON and OFF the developing bias applied to the developing roller 31.

The transfer bias application power source 58 is connected to the roller shaft of the transfer roller 30. The control circuit 54 controls the transfer bias application power source 58 to selectively switch the transfer bias applied to the transfer roller 30 between a regular transfer bias and an inverse transfer bias. The regular transfer bias is applied to the transfer roller 30 to transfer visible toner images from the photosensitive drum 27 to a sheet 3 that passes between the photosensitive drum 27 and the transfer roller transfer roller 30. The inverse transfer bias is applied to the transfer roller 30 before image transfer starts in order to electrically transfer toner from the transfer roller 30 to the photosensitive drum 27.

The transfer bias application power source 58 includes a switching switch 60, a constant current power source 61, and a constant voltage power source 62. The switching switch 60 is connected to the roller shaft of the transfer roller 30 and selectively connected to either the constant current power source 61 or the constant voltage power source 62. That is, the control circuit 54 controls the switching switch 60 to selectively connect the transfer roller 30 to the either the constant current power source 61 or the constant voltage power source 62. As a result, the transfer bias applied to the transfer roller 30 is selectively switched between the regular transfer bias from the constant current power source 61 and the inverse transfer bias from the constant voltage power source 62.

The regular transfer bias applied by constant current control of the constant current power source 61 is set to produce a bias at the surface of the transfer roller 30 that is lower than the surface electric potential of the photosensitive drum 27 directly before the photosensitive drum 27 comes into confronting contact with the transfer roller 30. When the regular transfer bias is applied to the transfer roller 30, then the visible toner image formed on the photosensitive drum 27 will be properly transferred to a sheet 3 that passes between the photosensitive drum 27 and the transfer roller 30. In the present example, the regular transfer bias is set to a constant current of −12 $\mu$A. Because the scorotron charge unit 29 charges the surface of the photosensitive drum 27 to about +900V, then the surface electric potential of the photosensitive drum 27 will be about 900V directly before the photosensitive drum 27 confronts and contacts the transfer roller 30. Portions of the photosensitive drum 27 that contact the transfer roller 30 while the transfer roller 30 is being applied with the regular transfer bias will be rendered to a surface electric potential of about +50V to +400V just before confronting and contacting the cleaning roller 51. This surface electric potential of the photosensitive drum 27 will be referred to as the first surface electric potential, hereinafter.

The inverse transfer bias applied by constant voltage control of the constant voltage power source 62 is set to produce a bias at the surface of the transfer roller 30 that is higher than the surface electric potential of the photosensitive drum 27 directly before the photosensitive drum 27 comes into confronting contact with the transfer roller 30. Therefore, by applying the inverse transfer bias to the transfer roller 30, toner that clings to the transfer roller 30 during image forming operations can be electrically transferred back to the photosensitive drum 27. In the present example, the regular transfer bias is set to a constant voltage of 1.6 kV. Because of the charging operation of the scorotron charge unit 29, a bias of about +900V exists at the surface of the photosensitive drum 27 directly before the photosensitive drum 27 confronts and contacts the transfer roller 30. Therefore, the surface electric potential of the photosensitive drum 27 is rendered to a second surface electric potential of about +900V to +1,000V after photosensitive drum 27 confronts and contacts the transfer roller 30 that is being applied with the regular transfer bias.

The cleaning bias application power source 55 is connected to the roller shaft of the cleaning roller 51. The control circuit 54 controls the cleaning bias application power source 55 to selectively apply a positive cleaning bias or a negative cleaning bias to the cleaning roller 51.

The negative bias is applied to electrically draw and temporarily collect toner that remains on the photosensitive drum 27 after visible images are transferred onto sheets. The negative bias is applied while the regular transfer bias is being applied to the transfer roller 30, that is, at transfer periods during image forming operations when a visible toner image is being transferred to a sheet 3. In this example, the negative bias is set to about −200V so as to be lower than the first surface electric potential (+200V to +400V).

The positive bias is applied to electrically return residual toner that was electrically drawn onto the transfer roller 30 back to the photosensitive drum 27. The positive bias is set to +700V so as to be higher than the first surface electric potential (+50V to +400V) and is applied during non-transfer periods of an image forming operation, that is, while the regular transfer bias is being applied to the transfer roller 30 and in between consecutive sheets 3 formed with images.

The secondary roller bias application power source 59 is connected to the roller shaft of the secondary roller 52. The control circuit 54 controls the secondary roller bias application power source 59 to apply to the secondary roller 52 a bias that maintains the direction of the electric field between the cleaning roller 51 and the secondary roller 52 unchanged even if the voltage applied to the cleaning roller 51 is switched. In this example, the control circuit 54 controls the secondary roller bias application power source 59 to apply a bias of about +750V to +800V to the secondary roller 52 while the cleaning roller 51 is applied with the positive bias (+700V) to return toner from the cleaner roller 51 back to the photosensitive drum 27, and to apply a bias of about 0V to −100V to the secondary roller 52 while the cleaning roller 51 is being applied with the negative bias (−200V) to draw residual toner from the photosensitive drum 27 to the cleaner roller 51.

Next, with reference to FIG. 4, pre-image formation cleaning operations performed by the cleaning roller 51 and the transfer roller 30 before image formation starts, temporarily toner collecting operations performed by the cleaning roller 51 during image formation, and paper dust removal operations performed by the cleaner device 50 both before and during image formation will be explained.

First, pre-image formation cleaning operations are performed when power of the laser printer 1 is turned ON and include cleaning collected residual toner from the cleaning roller 51 and toner from the transfer roller 30 and removing paper dust. When the power source is turned ON, then the main motor and the scorotron charge unit 29 are turned ON. The transfer roller 30 is maintained in a float condition wherein the switching switch 60 is connected to neither the constant current power source 61 nor the constant voltage power source 62, so that the transfer roller 30 has the same electric potential as the electrical potential of the photosensitive drum 27 because it is in contact with the photosensitive drum 27. While maintaining the float condition of the transfer roller 30, the negative bias (−200V) is applied to the cleaning roller 51 and the negative bias with a higher electric potential (−100V) is applied to the secondary roller 52.

Of the foreign objects (both toner and paper dust) clinging to the cleaning roller 51, only the negative-polarity paper dust moves to the high potential of the secondary roller 52. The positive-polarity toner remains on the cleaning roller 51. Because the cleaning roller 51 and the secondary roller 52 rotate together in the same direction and with the same peripheral speed, the secondary roller 52 does not mechanically scrape against the surface of the cleaning roller 51 so toner will not be scraped off the cleaning roller 51 by the secondary roller 52. Because the sliding contact member 53, which is made from unwoven fabric for example, abuts against the secondary roller 52, foreign objects such as paper dust on the smooth-surfaced secondary roller 52 can be scraped off and captured by the sliding contact member 53. Therefore, foreign objects can be properly removed from the secondary roller 52. It should be noted that in the present embodiment the electric potential at the secondary roller 52 is maintained higher than at the cleaner roller 51 until the power of the laser printer 1 is turned OFF, so that foreign objects such as paper dust are continuously removed from the cleaning roller 51 and the secondary roller 52 as long as the cleaning roller 51 and the secondary roller 52 are rotating.

Next, the inverse transfer bias is applied to the transfer roller 30. When the portion of the photosensitive drum 27 that contacted the transfer roller 30 when the inverse transfer bias was first applied to the transfer roller 30 arrives at the cleaning roller 51, then at this timing the positive bias (+700V) is applied to the cleaning roller 51 and the positive bias (+800V) with a higher electric potential is applied to the secondary roller 52. It should be noted that the electric potential at the secondary roller 52 is still higher than at the cleaner roller 51, so that negative polarity paper dust will continue to move to the secondary roller 52 and the positive polarity toner will remain clinging to the cleaning roller 51. Also, the sliding contact member 53 continues to scrape off and capture foreign objects so that the foreign objects can be reliably removed from the secondary roller 52.

As mentioned above, the scorotron charge unit 29 charges the surface of the photosensitive drum 27 to about +900V from the time that power of the laser printer 1 is turned ON. The inverse transfer bias is higher than the electric potential at the surface of the photosensitive drum 27 directly before contacting the transfer roller 30. Therefore, when the charged surface of the photosensitive drum 27 contacts the transfer roller 30 while the transfer roller 30 is being applied with the inverse transfer bias, toner that clings to the transfer roller 30 is electrically moved onto the photosensitive drum 27, resulting in a cleaning operation being performed on the transfer roller 30. The electric potential at the surface of the photosensitive drum 27 is increased to the second surface electric potential (about +900V to +1,000V) after contacting the transfer roller 30 while the transfer roller 30 is being applied with the inverse transfer bias.

Because the second surface electric potential (about +900V to +1,000V) at the photosensitive drum 27 is higher than the positive bias (+700V) applied to the cleaning roller 51, the toner that was electrically drawn from the transfer roller 30 onto the photosensitive drum 27 is further electrically drawn onto the cleaning roller 51 when the photosensitive drum 27 contacts the cleaning roller 51 while the cleaning roller 51 is being applied with the positive bias, and so is temporarily collected by the cleaning roller 51.

Then, the switching switch 60 is switched to connect the transfer roller 30 with the constant current power source 61 to develop the regular transfer bias at the transfer roller 30, while continuing to apply the positive bias to the cleaning roller 51. Because the regular transfer bias is lower than the surface electric potential of the photosensitive drum 27 directly before contact with the transfer roller 30, the surface of the photosensitive drum 27 that is charged by the scorotron charge unit 29 to about +900V is rendered to the lower first surface electric potential (+50V to +400V) directly after contact with the transfer roller 30 while the transfer roller 30 is being applied with the regular transfer bias. Because the first surface electric potential (+50V to +400V) of the photosensitive drum 27 directly before the photosensitive drum 27 confronts and contacts the cleaning roller 51 is lower than the positive bias (+700V) that is being applied to the cleaning roller 51, toner that was temporarily collected by the cleaning roller 51 is electrically drawn to the surface of the photosensitive drum 27 when the surface portions of the photosensitive drum 27 that were rendered to the first surface electric potential (+50V to +400V) contact the cleaning roller 51 as the cleaning roller 51 is being applied with the positive bias. As a result, a cleaning operation is performed on the cleaning roller 51.

Then, the transfer bias of the transfer roller 30 is again switched from the regular transfer bias to the inverse transfer bias while the cleaning roller 51 is still applied with the positive bias. In the same way as described above, the toner clinging to the transfer roller 30 is electrically drawn to the photosensitive drum 27, so that a cleaning operation is performed on the transfer roller 30. Further, the surface electric potential of the photosensitive drum 27 is rendered to the second surface electric potential (about +900V to +1,000V). Therefore, when the portion of the photosensitive drum 27 at the second surface electric potential (about +900V to +1,000V) reaches the cleaning roller 51, the toner that was electrically drawn from the transfer roller 30 onto the photosensitive drum 27 is again electrically drawn onto the cleaning roller 51.

When the transfer bias of the transfer roller 30 is switched from the inverse transfer bias back to the regular transfer bias while the cleaning roller 51 is being applied with the positive bias, the toner that was temporarily collected by the cleaning roller 51 is electrically drawn onto the surface of the photosensitive drum 27 after the surface of the photosensitive drum 27 is rendered to the first surface electric potential (about +50V to +400V), Therefore, a cleaning operation of the cleaning roller 51 is performed. It should be noted that toner that was electrically drawn from the cleaning roller 51 to the surface of the photosensitive drum 27 is collected by the developing roller 31 after being charged to a positive charge by the scorotron charge unit 29.

Here, the cleaning operations performed before image forming operations will be reviewed. The control circuit 54 controls the switching switch 60 to switch to apply the inverse transfer bias to the transfer roller 30 while the cleaning roller 51 is being applied with the positive bias. As a result, the toner that clings to the transfer roller 30 is electrically drawn to the photosensitive drum 27 so that a cleaning operation can be performed on the transfer roller 30. On the other hand, the transfer roller 30 is then applied with the regular transfer bias so that the toner that was collected and remains on the cleaning roller 51 is electrically drawn onto the photosensitive drum 27, so that a cleaning operation can be performed on the cleaning roller 51.

Accordingly, the cleaning bias applied to the cleaning roller 51 does not need to be selectively switched between a positive bias and a negative. That is, the surface electric potential of the photosensitive drum 27 is changed by only switching the transfer bias applied to the transfer roller 30, so that the toner can be selectively electrically drawn toward or away from the cleaning roller 51. Therefore, cleaning operations can be reliably performed while simplifying the configuration of the power sources and reducing production costs.

It is conceivable to selectively electrically draw toner to or away from the cleaning roller 51 by switching the cleaning bias that is applied to the cleaning roller 51. However, in this case, in order to insure that the toner moves toward or away from the cleaning roller 51 in the desired manner, the surface electric potential of the photosensitive drum 27 directly before contact with the cleaning roller 51 needs to be at a fixed level. Therefore, a charge removing lamp is an essential component of such a conceivable configuration in order to lower the surface electric potential to a constant level. However, in the present embodiment, the surface electric potential of the photosensitive drum 27 directly before the photosensitive drum 27 confronts and contacts the cleaning roller 51 is switched in order to electrically draw toner toward and away from the cleaning roller 51, so there is no need to use a configuration that requires a charge removing lamp. Therefore, the configuration can be simplified and the costs can be reduced.

After cleaning operations have been performed on the cleaning roller 51, image operations are performed for forming images on sheets 3.

Next, temporarily toner collecting operations performed by the cleaning roller 51 during image formation will be described. As shown in FIG. 4, during image forming operations while the main motor and the scorotron charge unit 29 are in an ON condition, the developing bias is applied to the developing roller 31 and the regular transfer bias is applied to the transfer roller 30. A negative bias (−200V) is applied to the cleaning roller 51 and a negative bias (−100V) is applied to the secondary roller 52 during image transfer to the first sheet 3, that is, while the first sheet 3 is passing between the photosensitive drum 27 and the transfer roller 30. As a result, portions of the photosensitive drum 27 just about to contact the cleaning roller 51 are rendered to the first surface electric potential. In this case, the first surface electric potential is about +50V to +100V at regions of the photosensitive drum 27 exposed by laser light and about +50V to +400V at unexposed regions of the photosensitive drum 27. Further, because the negative bias (−200V) is applied to the cleaning roller 51, toner remaining on the photosensitive drum 27 after image transfer is electrically drawn to and temporarily collected onto the cleaning roller 51 when the photosensitive drum 27 contacts the cleaning roller 51. That is, as described above, the cleaning roller 51 continues to electrically draw residual toner from the surface region of the photosensitive drum 27 that comes into contact with the sheet 3 as long as the cleaning roller 51 contacts the surface of the photosensitive drum 27.

On the other hand, the cleaning roller 51 is applied with the positive bias (+700V) while the portion of the photosensitive drum 27 that corresponds to a non-developed region, that is, in between successive sheets 3 that are formed with images one after the other, is contacting the developing roller 31. In this particular example, the cleaning roller 51 is applied with the positive bias (+700V) while the region of the photosensitive drum 27 that corresponds to between the end of the toner-developed image for the first sheet 3 and the start of toner-developed image for the second sheet 3 is located where the transfer roller 30 and the photosensitive drum 27 contact each other. At this time, the surface electric potential of the photosensitive drum 27 at portions just about to confront and contact the cleaning roller 51 is at the first surface electric potential because the regular transfer bias is still applied to the transfer roller 30 while the positive bias (+700V) is applied to the cleaning roller 51. Because both the cleaning roller 51 and the secondary roller 52 are applied with positive bias (+700V and +800V, respectively) that is higher than the first surface electric potential, the positively-charged toner that was electrically drawn to the cleaning roller 51 is in turn electrically discharged back to the surface of the photosensitive drum 27. That is, residual toner that was temporarily collected by the cleaning roller 51 is electrically discharged back to the photosensitive drum 27 while the surface portion of the photosensitive drum 27 where no image is developed, such as in between sheets, contacts the cleaning roller 51.

By controlling the cleaning roller 51 to electrically draw and discharge residual toner in this way, toner remaining on the photosensitive drum 27 after visible image transfer onto sheets can be temporarily collected using the cleaning roller 51. Even when toner remains on the photosensitive drum 27 in large amounts that cannot be completely collected by the developing roller 31 alone, the temporarily collection by the cleaning roller 51 will enhance the collecting ability of the developing roller 31 so that even large amounts of residual toner on the photosensitive drum 27 can be reduced to levels that have little influence on the subsequent visible image formed on the photosensitive drum 27. Subsequent images will therefore be free of ghosts.

After a desired number of sheets 3 have been formed with images using the above-described processes, the developing bias is turned OFF and the cleaning roller 51 is again applied with the positive bias (+700V). As a result, residual toner that was electrically drawn onto the cleaning roller 51 during visible image transfer for the last sheet 3 is electrically discharged back onto the photosensitive drum 27. Then, the regular transfer bias and the cleaning bias are turned OFF in this order and then the main motor and the scorotron charge unit 29 are turned OFF. As a result, operations of the laser printer 1 are completed.

In this way, the laser printer 1 uses the cleanerless method to collect toner, wherein the developing roller 31 collects toner that remains on the surface of the photosensitive drum 27 after the transfer roller 30 transfers a visible toner image onto a sheet 3. In addition, during cleaning operations performed using the cleaning roller 51, the surface electric potential of the photosensitive drum 27 is switched between the first surface electric potential and the second surface electric potential, in order to electrically attract and discharge toner to and from the cleaning roller 51. In other words, cleaning operations are performed using the cleaning roller 51 without selectively applying a cleaning bias to the cleaning roller 51. For this reason, the power source configuration can be simplified and costs can be reduced. Also, the cleaning operation performed by the cleaning roller 51 can be reliably performed. Further, there is no need to provide a charge removing lamp, so costs can be simplified because the device configuration is simpler. The simpler configuration translates not only into a more compact device configuration and reduced costs, but also to a device capable of properly forming images over a long period of time.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment describes that during the pre-image forming cleaning operation performed by the cleaning roller 51 before image formation starts, the surface electric potential of the photosensitive drum 27 is switched between the first surface electric potential and the second surface electric potential by switching the transfer bias that is applied to the transfer roller 30 between the regular transfer bias and the inverse transfer bias. However, the surface electric potential of the photosensitive drum 27 could instead be switched between the first surface electric potential and the second surface electric potential by turning the laser beam from the scanner unit selectively ON and OFF. That is, while scorotron charge unit 29 is turned ON, the switching switch 60 is switched out of connection with both the transfer bias application power source 58 or the secondary roller bias application power source 59. As a result, no transfer bias is applied to the transfer roller 30, so that the transfer roller 30 is placed in a "float" condition. The first surface electric potential is achieved by scanning the laser light is scanned across the surface of the photosensitive drum 27 to reduce the electric potential at the surface of the photosensitive drum 27. The second surface electric potential is achieved by turning the laser light OFF.

The embodiment describes using positively charging toner. However, negatively charging toner can be used instead. In this case, the polarity of voltage applied to the scorotron charge unit 29, the developing roller 31, the transfer roller 30, the cleaning roller 51, and the secondary roller 52 would need to be reversed. Also, when negatively charging toner is used, then the secondary roller 52 would only be capable of removing positive polarity paper dust.

What is claimed is:

1. A cleaner, comprising:

a first roller for removing foreign matter from a photosensitive body of an image forming device; and a second roller disposed in confrontation with the first roller, wherein an electric field developed between the first roller and the second roller moves foreign matter having a predetermined charge polarity from the surface of the first roller to the surface of the second roller, wherein the first roller and the second roller contact each other at their outer peripheral surfaces at a contact portion and move in the same direction at the contact portion, and wherein the first roller and the second roller move in the same speed at the contact portion.

2. A cleaner as claimed in claim 1, further comprising a slide-contact member that contacts the surface of the second roller and scrapes foreign matter from the surface of the second roller.

3. A cleaner as claimed in claim 2, wherein the slide-contact member includes a porous material made from at least one of sponge and unwoven fabric.

4. A cleaner as claimed in claim 1, further comprising:

a first voltage application unit for applying voltage to the first roller;

a second voltage application unit for applying voltage to the second roller; and a control unit that controls the first voltage application unit to change polarity of voltage applied to the first roller to one polarity when toner is to be drawn from the photosensitive body and to the opposite polarity when toner is to be released onto the photosensitive body, and controls second voltage application unit to apply voltage to the second roller that does not change the direction of the electric field between the first roller and the second roller, even if the second voltage application unit changes voltage applied to the first roller.

5. A cleaner as claimed in claim 4, wherein the first roller has a higher peripheral speed than the photosensitive body.

6. A cleaner as claimed in claim 1, wherein an outer surface of the first roller is a resilient and porous member.

7. A cleaner as claimed in claim 1, wherein the second roller is conductive and has a smooth surface.

8. A cleaner as claimed in claim 1, wherein the first roller removes foreign objects from the photosensitive body using a combination of mechanical scraping-off force and electrostatic drawing force, the second roller selectively drawing only paper dust from the first roller using mainly electrostatic drawing force.

9. A cleaner as claimed in claim 1, further comprising a toner supply unit that supplies non-magnetic single-component toner having a positively charging nature to the photosensitive body.

10. A cleaner as claimed in claim 9, further comprising:

a bias application unit that selectively applies a positive bias and a negative bias to the first roller; and a control unit that controls the bias application unit to apply the positive bias to the first roller to draw the toner that was supplied by the toner supply unit away from the photosensitive body to the first roller and to apply the negative bias to the first roller to return the toner from the first roller to the photosensitive body.

11. A cleaner as claimed in claim 10, wherein the bias application unit, while applying the positive bias to the first roller to draw the toner away from the photosensitive body, further applies a bias that is higher than the positive bias to the second roller and, while applying the negative bias to the first roller to return the toner to the photosensitive body, further applies a bias that is higher than the negative bias to the second roller.

12. An image forming device comprising:

a photosensitive body; and a cleaner including:

a first roller for removing foreign matter from the photosensitive body of an image forming device; and a second roller disposed in confrontation with the first roller, wherein an electric field developed between the first roller and the second roller moves foreign matter having a predetermined charge polarity from the surface of the first roller to the surface of the second roller, the first roller and the second roller contact each other at their outer peripheral surfaces at a contact portion and move in the same direction at the contact portion, and the first roller and the second roller move at the same speed at the contact portion.

13. An image forming device as claimed in claim 12, further comprising:

a charge unit that develops a uniform charge on the photosensitive body;

a developing unit that develops images on the photosensitive body using toner into visible images; and a transfer member that transfers the visible images from the photosensitive body onto sheets, wherein the charge unit, the developing unit, the transfer member, and the first roller of the cleaner device are disposed around the photosensitive body in this order starting from an upstream side with respect to a rotational direction of the photosensitive body.

14. An image forming device as claimed in claim 12, further comprising a developing unit that supplies non-magnetic single-component toner having a positively charging nature to the photosensitive body to develop images on the photosensitive body.

15. An image forming device as claimed in claim 14, further comprising:

a bias application unit that selectively applies a positive bias and a negative bias to the first roller; and a control unit that controls the bias application unit to apply the positive bias to the first roller to draw the toner that was supplied by the developing unit away from the photosensitive body to the first roller and to apply the negative bias to the first roller to return the toner from the first roller to the photosensitive body.

16. An image forming device as claimed in claim 15, wherein the bias application unit, while applying the positive bias to the first roller to draw the toner away from the photosensitive body, further applies a bias that is higher than the positive bias to the second roller and, while applying the negative bias to the first roller to return the toner to the photosensitive body, further applies a bias that is higher than the negative bias to the second roller.

* * * * *